US007183974B1

(12) United States Patent
Minkoff

(10) Patent No.: US 7,183,974 B1
(45) Date of Patent: Feb. 27, 2007

(54) METHODS AND APPARATUS FOR INCREASING THE EFFECTIVE RESOLVING POWER OF ARRAY ANTENNAS

(75) Inventor: John Minkoff, Englewood, NJ (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 279 days.

(21) Appl. No.: 10/850,443

(22) Filed: May 21, 2004

(51) Int. Cl.
*H01Q 3/00* (2006.01)

(52) U.S. Cl. ..... 342/377; 342/381

(58) Field of Classification Search ..... 342/372–373, 342/377, 380–384; 455/561–562.1
See application file for complete search history.

(56) References Cited

U.S. PATENT DOCUMENTS

| | | | |
|---|---|---|---|
| 4,338,605 | A | 7/1982 | Mims |
| 4,651,155 | A | 3/1987 | Baurle et al. |
| 4,916,454 | A | 4/1990 | Bull et al. |
| 5,343,211 | A | 8/1994 | Kott |
| 5,572,219 | A | 11/1996 | Silverstein et al. |
| 5,579,016 | A | 11/1996 | Wolcott et al. |
| 5,841,395 | A | 11/1998 | Simone |
| 5,926,135 | A | 7/1999 | Minkoff |
| 5,952,965 | A | 9/1999 | Kowalski |
| 6,108,564 | A | 8/2000 | Minkoff |
| 6,486,828 | B1 | 11/2002 | Cahn et al. |
| 6,549,171 | B1 | 4/2003 | Mailloux |
| 6,618,007 | B1 | 9/2003 | Miller |
| 6,661,366 | B2 | 12/2003 | Yu |
| 7,026,989 | B1 | 4/2006 | Minkoff et al. |
| 2003/0020650 | A1 | 1/2003 | Chevalier et al. |
| 2003/0025633 | A1 | 2/2003 | Cai et al. |
| 2003/0085833 | A1 | 5/2003 | Yu |
| 2003/0128160 | A1 | 7/2003 | Sim |
| 2004/0027279 | A1 | 2/2004 | Jacomb-Hood |

OTHER PUBLICATIONS

Minkoff, John, a new very high resolution interference rejection method with potential for radio astronomy application, Radio Science, vol. 38, No. 3, 1042, Copyright 2003 by the American Geophysical Union, May 23, 2003.

*Primary Examiner*—Thomas H. Tarcza
*Assistant Examiner*—F H Mull
(74) *Attorney, Agent, or Firm*—Edell, Shapiro & Finnan, LLC

(57) ABSTRACT

Methods and apparatus for improving the effective resolving power of an array antenna are described that are not limited by the physical characteristics of the array. In an array with M elements, up to M−1 directional vectors may be selected, preferably at angles corresponding to the main lobe and/or side lobes of an array antenna beam pattern. A received signal plus interference (s+i) is zero-transformed to eliminate interference received from the plurality of selected directions. The zero-transformed s+i is then restored to obtain the signal of interest observed at maximum gain undisturbed by interference incident from arbitrarily close signal sources. The approach may be combined with conventional beamforming techniques to remove interference incident from angles corresponding to the side lobes, where conventional beamforming techniques are most effective.

21 Claims, 4 Drawing Sheets

METHODS AND APPARATUS FOR INCREASING THE EFFECTIVE RESOLVING POWER OF ARRAY ANTENNAS

BACKGROUND OF THE INVENTION

1. Field of the Invention

The present invention pertains to the processing of signals received via an array antenna. In particular, the present invention pertains to methods and apparatus for increasing the effective resolving power of an array antenna.

2. Description of the Related Art

Array antennas are used in a wide variety of applications to transmit and receive directed beams of electromagnetic energy. An array antenna beam pattern, which typically includes a main lobe and side lobes, defines the angular dependence of the array gain. The shape and direction of an array antenna beam pattern are determined by the relative phases and amplitudes applied at the individual antenna elements that constitute the array via a process referred to as beamforming. For example, where hardware permits the relative phases of the antenna elements to be adjusted during operation, the main lobe of the antenna beam pattern can be steered over a range of different directions to transmit a signal in a selected direction or to receive a signal arriving from a particular direction.

When receiving a signal, received power is maximized by pointing the main lobe of the array antenna beam pattern in the direction of a source of a signal of interest. The resolving power of the array antenna is determined by the width of the beam pattern main lobe, commonly referred to as the array beamwidth. Assuming that the main lobe of the antenna beam pattern is pointed in the direction of a source of a signal of interest, a second signal from a source separated in angle by less than one array beamwidth may be identified as part of the signal of interest and may be amplified along with the signal of interest, thereby contributing significant interference to the signal of interest. The minimum beamwidth that can be achieved using beamforming techniques is determined, in part, by the number of array elements and the spacing between array elements. Hence, using conventional array signal reception techniques, the resolving power of an array antenna and the ability to receive a single isolated signal from among a plurality of signals from a plurality of closely spaced signal sources, is established by the physical characteristics of the array antenna.

Due to many of the same limitations identified above, conventional array signal reception techniques also limit the ability of an array antenna to identify and/or locate separate signal sources within a field of physical space. For example, a beam pattern's main lobe may be rotated, or scanned, through a field of physical space to determine the radial distribution of radiation sources relative a central boresight of the main lobe. Two radiation sources separated in angle by more than the beamwidth may be identified using conventional beamforming technique as two separate radiation sources. However, if two or more radiation sources are not separated in angle by more than one-half of the beam pattern beamwidth, the radiation sources will not be identified as separate radiation sources, but rather as a single source. As stated above, the minimum beamwidth that can be achieved using beamforming techniques is determined, in part, by the number of elements and the spacing between array elements. Hence, using conventional array signal reception techniques, the resolving power of an array antenna and the ability to identify separate signal sources within a field of physical space containing a plurality of signal sources, is established by the physical characteristics of the array antenna.

FIG. 1 depicts, graphically, a conventional approach to interference-rejection based upon the use of beamforming techniques. In an interference-rejection approach based upon beamforming techniques, a beam is formed on a signal of interest (FIG. 1 at 102) and a beam is also formed on the interference source (FIG. 1 at 104), typically by use of adaptive techniques. The contribution of the interference to the signal beam is then removed by subtracting the interference beam from the signal beam, resulting in an interference-rejection beam (FIG. 1 at 106) with a "null" for the angular direction of the interference. As demonstrated in FIG. 1 at 106, the results of such beamforming techniques typically produce a beam pattern that is distorted from the original beam pattern, at 102. For example, as shown in FIG. 1 at 106, the result of the subtraction, aside from being distorted, points in the wrong direction, yielding an erroneous direction for the signal of interest.

Conventional techniques based upon beamforming, as addressed above with respect to FIG. 1, are limited in their ability to reject interference from sources closely spaced in angle to a signal source of interest. Upon subtracting from the signal beam a beam formed on the interference source, a null is produced in the signal beam pattern; however, the nulling is not selective, as demonstrated in FIG. 1 at 106. The nulling will affect reception of a signal of interest as well as the interference. As signal and interference become closer together in angle the signal will, increasingly, also become rejected by the process along with the interference. This sets a limit on the minimum signal/interference separation that can be effectively dealt with in rejecting interference by means of beamforming techniques. Once again, the limitation is due primarily to the array beam pattern beamwidth, which, as explained above, is determined by physical characteristics of the array antenna. Hence, using conventional array beamforming techniques, the ability to reject as interference signals in close proximity to a signal of interest, is significantly limited by the physical characteristics of the array antenna.

Conventional signal processing approaches based upon beamforming techniques are limited in that the resolving power of the array is limited to the minimum beamwidth that can be achieved using the array. This sets a limit on the minimum signal/interference source separation that can be effectively dealt with in rejecting interference, isolating an individual signal and identifying individual sources of interference, as described above, as well as in other array signal processing applications. However, beamforming based techniques, as described above, may be effectively used in applications in which the signal/interference source separation is greater than one-half beamwidth. As a result, conventional beamforming/nulling techniques may be effectively used to remove any interference received form sources at angles corresponding to the beam pattern side lobes. For example, the beamforming/nulling techniques described above with respect to FIG. 1, may be used to remove interference incident upon an array antenna at angles corresponding to side lobes of the array beam pattern.

At least for the limitations identified above, a need remains for methods and apparatus for improving the effective resolving power of array antennas and for processing signals received via an array antenna that are not limited by the physical characteristics of the array antenna and the minimum beamwidth that can be achieved with the array antenna. Such techniques would preferably support improved signal isolation, signal source identification and interference-rejection without requiring changes to the physical characteristics of existing array antennas and/or other signal receiving hardware.

SUMMARY OF THE INVENTION

Methods and apparatus for improving the effective resolving power of an array antenna are described that are not limited by the physical characteristics of the array antenna and the minimum beam pattern beamwidth that can be achieved with the antenna. The effective resolving power of an array antenna is improved without changes to the physical characteristics of the array antenna and/or hardware associated with a receiving device.

A signal received by an array antenna may be treated as a signal vector with a plurality of elements, each element corresponding to the output of an element of the array antenna. The received signal, or signal vector, may be assumed to include interference from a plurality of interference sources. Each potential source of interference may be represented as a directional vector based upon a specific angular direction of the potentially interfering source within the field of view of the array antenna.

In accordance with the present invention, a zero-transformation, or ZT, matrix is generated for which each vector representing a potential source of interference is a member of the matrix null space. By applying the zero-transformation matrix to the received signal vector, a zero-transformation is performed in which the potential interference source directional vectors are transformed into the zero vector. For an array of M elements, as many as M−1 potential interference source directional vectors may be zero transformed in order to eliminate potential sources of interference received at the array antenna at angles corresponding to angles within main lobe of the array antenna beam pattern.

Although the zero-transformations are applied to selected directional vectors, or point sources, the zero-transformations reject interference over an extended region, since directional vectors in close proximity to a selected directional vector have significant components along the direction of the selected directional vector which are also removed by application of the zero-transformation to the selected directional vectors. The result is an extended-zero-transformation (EZT), that operates over a range of angles rather than merely the angles associated with directional vectors selected for extended-zero-transformation.

In accordance with the present invention, a sufficient number of the M−1 directional vectors are selected corresponding to angles within the main lobe and/or side lobes of the array antenna beam pattern and an extended-zero-transformation matrix based upon the selected directional vectors is applied to the received signal vector. Application of the extended-zero-transformation eliminates from the received signal vector interference over a range of angles for each selected directional vector and creates a transformed signal vector free of the eliminated interference.

The EZT transformed signal vector is then restored to obtain the signal of interest, observed at maximum gain, undisturbed by any interference incident within the main lobe and/or side lobes. The approach increases the effective resolving power of the array antenna by allowing a signal of interest received via the direction of the main lobe boresight to be observed at maximum gain undisturbed by any interference incident from any arbitrarily close signal sources within the main lobe and/or side lobes. Beamforming plays no part in the extended-zero-transformation and signal restoration based technique described; hence, no physical array characteristics such as beamwidth and resolution come into play, and the aforementioned limitations imposed in the resolving power of the array are avoided. The approach does not run counter to any laws of physics, since two arbitrarily close signal sources within the main lobe and/or side lobes would be identified sequentially in time rather than simultaneously. The extended-zero-transformation based interference rejection approach may be used to eliminate any interference incident within the main lobe. In effect, each individual source within the main lobe may be observed by treating other sources within the main lobe as interference.

The described signal processing approach eliminates any potential interference incident within a received signal by zero-transforming as many as M−1 directional vectors corresponding to angles within and/or near the main lobe and/or side lobes of the beam pattern supported by the array antenna. In addition to the extended-zero-transformation and restoration techniques, described above, conventional beamforming/nulling approaches may be used to remove any remaining interference incident in the side lobes, where beamforming/nulling is most effective. In this manner, the described extended-zero-transformation approach and beamforming/nulling based approaches may be applied for maximum advantage.

The above and still further features and advantages of the present invention will become apparent upon consideration of the following definitions, descriptions and descriptive figures of specific embodiments thereof wherein like reference numerals in the various figures are utilized to designate like components. While these descriptions go into specific details of the invention, it should be understood that variations may and do exist and would be apparent to those skilled in the art based on the descriptions herein.

DESCRIPTION OF THE PREFERRED EMBODIMENTS

Figure 1:
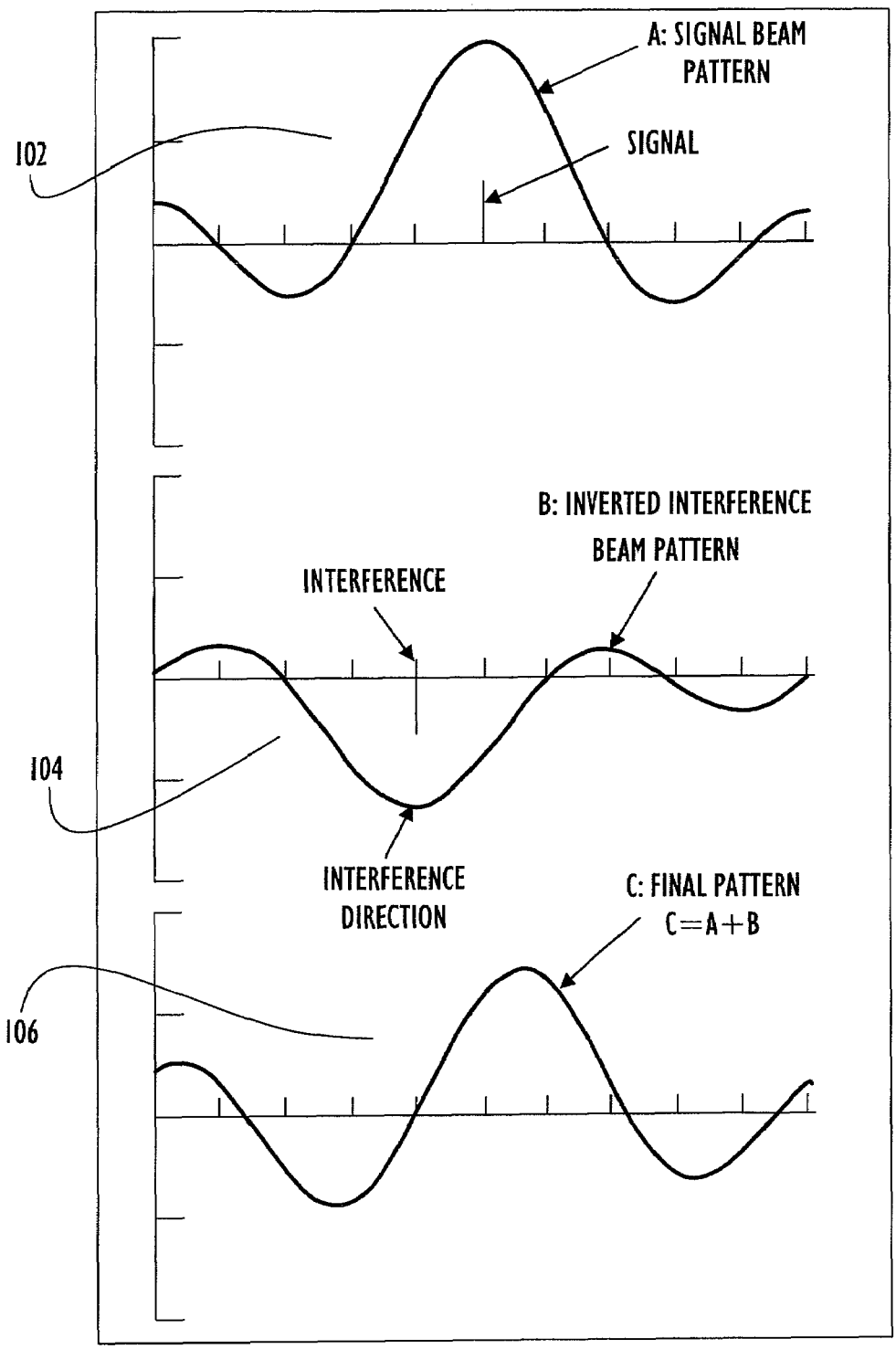
FIG.1 PRIOR ART
FIG. 1 is a graphical representation of interference-rejection using conventional beamforming/nulling techniques.

The following detailed explanations of FIGS. 2–5 and of the preferred embodiments reveal the methods and apparatus of the present invention.

Interference is rejected from a received signal at angles corresponding to angles within the main and/or side lobes of an array beam pattern using an extended-zero-transformation (EZT) that transforms potential point sources of interference, represented as directional vectors, into the null-space. The approach differs fundamentally from conventional approaches based upon beamforming/nulling techniques in that the extended-zero-transformation is applied directly to the array antenna element outputs, rather than to beam-steering vectors. Therefore, the described approach is not limited by the physical characteristics of the array antenna with which the described approach is used, such as beamwidth and resolution, because conventional beamforming techniques are not used. The approach supports high-resolution interference rejection that cannot be achieved using conventional beamforming/nulling based techniques. Further, there is no fundamental limitation on the minimum angular separation between a source of an interfering signal that can be rejected and a source of a signal of interest that can be recovered intact, undisturbed by the process.

N potential sources of interference may be rejected from a signal received by an array antenna with M elements, where, M=N+1. Interference rejection of one or more interferers is accomplished by a single matrix multiplication, independent of the number of interferers. The interfering signals are removed selectively at each array element, while signals of interest remain completely recoverable. Upon application of the described extended-zero-transformation and signal restoration techniques, a restored signal is undistorted, identical to what the signal would have been had there been no interference processing. Further, coherent summation over the array of the restored signals typically yields 10 log M dB improvement in signal-to-noise ratio, where M equals the number of elements in the array.

By way of a simplified example based upon a two-element array, a single signal of interest and a single selected direction of potential interference, the signal and interference may be represented at the two-element array by the vector equations (1) and (2), below:

$$s = \begin{bmatrix} 1 \\ e^{i\theta} \end{bmatrix} \tag{1}$$

$$i = \begin{bmatrix} 1 \\ e^{i\phi} \end{bmatrix} \tag{2}$$

where the signal and interference directions are represented, respectively, by the angles θ and Φ and each is of the form $2\pi f\tau$, respectively, and where τ represents the propagation delay between the first and second array elements in these examples.

In preparation for the extended-zero-transformation, a rank-deficient matrix A is constructed, of rank unity in this example, whose null-space contains the vector i as given by equation (2).

$$A = \frac{1}{2}\begin{bmatrix} 1 & -e^{-i\phi} \\ -e^{i\phi} & 1 \end{bmatrix} \tag{3}$$

and multiplication of s+i by A yields:

$$\begin{aligned} A(s+i) &= \frac{1}{2}\begin{bmatrix} 1 & -e^{-i\phi} \\ -e^{i\phi} & 1 \end{bmatrix}\left[\begin{bmatrix} 1 \\ e^{i\theta} \end{bmatrix} + \begin{bmatrix} 1 \\ e^{i\theta} \end{bmatrix}\right] \\ &= \begin{bmatrix} 1T \\ e^{j\theta}T^* \end{bmatrix} + \begin{bmatrix} 0 \\ 0 \end{bmatrix} = \begin{bmatrix} s_1' \\ s_2' \end{bmatrix} \text{ where} \\ T &= \frac{1 - e^{j(\theta-\phi)}}{2} \end{aligned} \tag{4}$$

Thus the interference i is eliminated and by dividing $s_1'$ by T and $s_2'$ by T* the transformation by A on the signal is reversed, yielding the desired signal vector $$s = \begin{bmatrix} s_1'/T \\ s_2'/T^* \end{bmatrix} \tag{5}$$

Using the extended-zero-transformation approach, potential sources of interference are eliminated selectively at each array element by the transformation of the selected directional vectors into the zero vector. Conventional beamforming process play no part. After interference-rejection with EZT, beamforming, if performed, yields an undistorted signal, as if the interference had not existed. The signals of interest can be exactly recovered. Note, however, that in eliminating the effect of the transformation by A on s by removing the complex multiplicative factors $$T = \left[\frac{1 - e^{i(\theta-\phi)}}{2}\right] \text{ and } T^* = \left[\frac{1 - e^{-i(\theta-\phi)}}{2}\right] \tag{6}$$

we divide by quantities that become progressively smaller in magnitude as signal and interference become closer together in angle. This will amplify any noise or other interference that may be present. Thus, the minimum tolerable, but nonzero, angular separation between a signal of interest and a potential interfering source that one wishes to reject is a function of the receiver noise characteristics. There is no limitation other than signal-to-noise ratio considerations on the minimum angular separation.

A significant difference between conventional approaches based upon beamforming techniques and the EZT approach described here is the objects to which the matrix or extended-zero-transformation is applied. In conventional approaches the extended-zero-transformation operation is applied to the beam-steering vectors for projection into a subspace orthogonal to the interference. The zero-transformed vectors are then applied to s+i in a conventional beam-forming operation to produce a null in the direction of the interference, by which the interference is reduced, and signals of interest close in angle to the interference, i.e., nominally within a beamwidth, will be equally affected by the null. With the EZT based approach of the present invention, the transformation is applied directly to the array output s+i, which selectively removes the components of i directly from each array element leaving only the transformed but recoverable signal vector s, with no physical array issues such as limitations imposed by angle resolution and array beamwidth, or beam-steering vectors, coming into play.

By way of a more realistic example, assuming that a select set of directional vectors identified as potential sources of interfering signals incident at an M-element array are represented as $$g(t)\begin{bmatrix} C_1 e^{i\phi_1} \\ C_2 e^{i\phi_2} \\ \vdots \\ C_M e^{i\phi_M} \end{bmatrix} = g(t)i \tag{7}$$

where $\Phi_i$ represents the incremental delays between elements as in equation (1), and $C_i$ is assumed to be known, but there are no other restrictions (e.g., the array spacing need not be uniform, the amplitudes need not be equal, and so forth). The time dependence represented by g(t), which multiplies the vector i, other than being contained within bandwidth and sampling-rate capability of the receiver, may be assumed to be uniform over the array. As noted, the extended-zero-transformation processing may be implemented by a matrix multiplication of the form $$Ai=0 \tag{8}$$

If the M×M matrix A is full rank, there is only the trivial solution i=0. If there are k<M interferers, we therefore seek a rank-deficient matrix A, of rank M−k, satisfying $$Ai_n=0,\ n=1,2\ldots k \tag{9}$$

where the vectors $i_n$, populating the k-dimensional null-space of A, are all of the form of equation (7). Ordinarily, one is given a matrix and asked to find the null-space. Here, the null-space and the selected directional vectors representing potential sources of interference are given, and the matrix needs to be constructed. Matrix A is constructed by making use of a theorem from matrix algebra which states that if an M×M Hermitian matrix K has a k-fold repeated eigenvalue λ, the matrix K−λI, where I is the M×M identity, has rank M−k. Consider the M×M matrix K written in dyadic form as $$K = \sum_{m=1}^{k} v_m v_m^{\dagger} \tag{10}$$

where † denotes Hermitian conjugate and the $v_m$ are an orthonormal set of M-element column vectors. The matrix K is Hermitian and has a k-fold repeated characteristic root equal to unity. The remaining roots are all zero. Therefore the extended-zero-transformation matrix $$A = I - \sum_{m=1}^{k} v_m v_m^{\dagger} \tag{11}$$

is of rank M−k. The necessary $v_m$ are then determined by solving the equations $$AI_n = \left[I - \sum_{m=1}^{k} v_m v_m^{\dagger}\right] i_n = 0\ n = 1, 2, \ldots k \tag{12}$$

$$\sum_{m=1}^{k} (v_m, i_n) v_m = i_n\ n = 1, 2, \ldots k \tag{13}$$

Thus, perhaps unexpectedly, in seeking the matrix A, one arrives at a familiar Gram-Schmidt orthogonalization procedure. This brings up another major difference between the described extended-zero-transformation approach and beam-forming/nulling schemes. Here, Gram-Schmidt is applied in order to produce an orthonormal coordinate system as a basis set for representation of the set of selected directional vectors. In the beamforming/nulling schemes, Gram-Schmidt is used to orthogonalize the beam-steering vectors with respect to the interference vectors. In the present invention, the extended-zero-transformation operators generated by the Gram-Schmidt procedure are applied to different objects for entirely different purposes. Now, for purposes of illustration, let M=4, k=3. The maximum dimension of the null space of an M×M matrix is M−1, which sets the limit on the largest number of potential sources of interference that can be rejected with this approach by a single matrix operation. In this case, for M=4, application of matrix A yields:

$$A(s+i_1+i_2+i_3)=As \tag{14}$$

Now, as noted above in connection with equations (4) and (5), the signal, transformed in the removal of the interference, must as part of the process be retransformed exactly back to it original state. For purposes of interference rejection it was only necessary to express the interference as in equation (7) with g(t) uniform over the array, but with essentially no other assumptions. For purposes of eliminating the effects of the transformation on the signal, the signal vector is written as:

$$s = Ce^{i(2\pi ft+\alpha)}\begin{bmatrix} e^{-i(2\pi f\tau_1)} \\ e^{-i(2\pi f\tau_2)} \\ e^{-i(2\pi f\tau_3)} \\ e^{-i(2\pi f\tau_4)} \end{bmatrix} \tag{15}$$

If the signal source is sufficiently narrowband, the fractional bandwidth is most likely the relevant quantity, and equation (15) applies as is. If, on the other hand, the signal source of interest occupies a significant bandwidth, an expression such as equation (15) may be written for each of the important Fourier components of the signal source as, for example, would be observed at the outputs of a bank of narrowband filters, with the frequency f incremented in these expressions accordingly. Each such Fourier component may then be processed separately, which, as described above, contributes to the computational complexity.

In equation (15), C is a constant, which could represent the amplitude of a weak radio source, α allows for a phase shift, and the $\tau_m$ are the incremental delays between elements. The transformation cannot be reversed by inverting A, because A is singular by construction. However, the transformed signal at the mth element can be written as $$[As = (I - K)s]_m \tag{16}$$
$$= Ce^{i(2\pi f(t-\tau_m)+\alpha)} - \sum_{n=0}^{3} CK_{m,n}e^{i(2\pi f(t-\tau_n)+\alpha)}$$
$$= Ce^{i(2\pi f(t-\tau_m)+\alpha)}\left[1 - \sum_{n=0}^{3} K_{m,n}e^{i(2\pi f(\tau_m-\tau_n))}\right]$$

where the $K_{m,n}$ are the elements of K. Thus the transformation of the signal amounts to multiplying the signal at the mth element by the complex number T(m) given by $$T(m) = 1 - \sum_{n=0}^{3} K_{m,n}e^{i2\pi f(\tau_m-\tau_n)} \tag{17}$$

which is a generalization of the T factors described above with respect to equation (6). In this expression, the elements of K are determined by solving equations (10)–(13) based upon the selected set of directional vectors selected as potential sources of interference, and the values for $\tau$ are the incremental delays between array elements, as determined by the location of the signal source of interest. That is, the values for $\tau$ are defined by the direction that one wishes to view under interference-free conditions (i.e., the boresight of the main lobe). Note that K is always an exactly known quantity. Hence, for any value of $\tau$, the signal can always be restored exactly, independently of any errors in the assumed interference locations.

Figure 2:
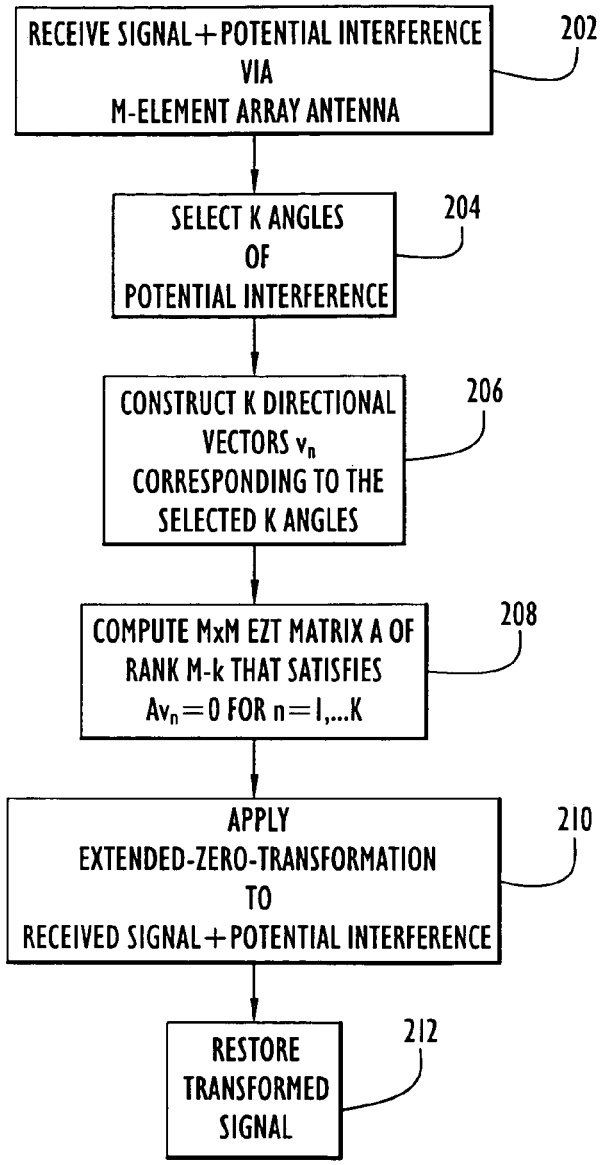
FIG. 2 is a functional flow diagram of a technique for increasing the effective resolving power of an array antenna by performing extended-zero-transformation and signal restoration in accordance with an exemplary embodiment of the present invention.

The extended-zero-transformation matrix A is essentially a tool that can be used to eliminate as many as M−1 potential sources of interference received by an array antenna with M array elements. The procedure for accomplishing this result is now described in connection with the flow diagram shown in FIG. 2. As shown in FIG. 2, a signal plus any potential interference (s+i) may be received, at step 202, via an array antenna with M array elements. K angular directions, each representing a potential source of interference within the main and/or side lobes, may be then selected, at step 204, and used to construct, at step 206, K vectors $v_n$ corresponding to zero-transformations to be applied to s+i, where K is less than or equal to M−1. At step 208, the K vectors are used to generate an extended-zero-transformation matrix A, as described above with respect to equation (11) and equation (13). The EZT matrix may then be applied, at step 210, to the received s+i to produce a transformed s+i in which the selected interference vectors have been transformed into the zero vector, as described above with respect to equations (4) and (14). Given that application of an extended-zero-transformation operates over a range of angles rather than merely the angles associated with directional vectors selected for extended-zero-transformation, assuming that a sufficient number of directional interference vectors are applied at angles corresponding to the main lobe and/or side lobes, any interference incident within the main lobe and/or side lobes may be removed from the transformed s+i. The transformed s+i may be restored, at step 212, as described above with respect to equations (5)–(6) and equations (15)–(17) to obtain the signal, observed at maximum gain, undisturbed by any interference incident within the main lobe and/or side lobes.

The K angular directions selected at step 204, may be selected based upon an analysis of the signal received, or distributed in any manner at angles corresponding to angles within the main lobe and/or side lobes of the array antenna in order to reject interference from suspected and/or potential sources of interference. If the number of array antenna element, M, is large, the number of K (i.e., M−1) angular directions, selected at step 204, and K vectors constructed at step 206, may be large enough to allow the selected angular directions to be closely and evenly spaced throughout the main lobe and/or side lobes. If M is small (e.g., 2, 3, etc.) the angular directions may be strategically selected based upon an analysis of the received signal. Further, the number of angular directions and angular directions selected may by dynamically refined until a desired level of performance is achieved. The K angular directions selected at step 204 may be selected so that the selected angular directions circumscribe, or ring, the main lobe bore sight, so that application of the extended-zero-transformation transforms into the null vector interference from any arbitrarily close signal sources within the main lobe and/or side lobes. The approach increases the effective resolving power of the array antenna by allowing a signal of interest received via the direction of the main lobe boresight to be observed at maximum gain undisturbed by any interference incident from any arbitrarily close signal sources within the main lobe and/or side lobes. The extended-zero-transformation based interference rejection approach may be used to eliminate any potential interference incident at angles corresponding to the main lobe and/or side lobes of the antenna beam pattern. Using this approach individual signals within the main lobe may be observed by treating other sources within the main lobe as interference.

The described signal processing approach eliminates any potential interference incident within a received signal by zero-transforming as many as M−1 directional vectors corresponding to angles within and/or near the main lobe and/or side lobes of the beam pattern supported by the array antenna. In addition to the extended-zero-transformation and restoration techniques, described above, conventional beamforming/nulling approaches may be used to remove any remaining interference incident in the side lobes, where beamforming/nulling is most effective. In this manner, the described extended-zero-transformation approach and beamforming/nulling based approaches may be applied for maximum advantage.

Figure 3:
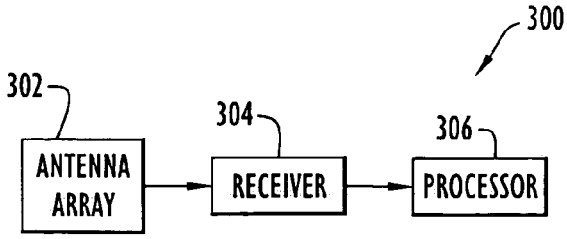
FIG. 3 is a block diagram of a signal processing device configured to receive a signal via an array antenna and to perform extended-zero-transformation and signal restoration in accordance with an exemplary embodiment of the present invention.

FIG. 3 is a block diagram that conceptually illustrates the functional modules in a system 300 for applying the described extended-zero-transformation and signal restoration approach, as described above, to a signal plus interference (S+I) received via an array antenna. FIG. 3 is a conceptual diagram illustrating major functional units and overall architecture, and does not necessarily illustrate physical relationships. Signals from one or more sources are received by array antenna 302, where signals received by individual array elements may be phase shifted and amplitude adjusted in accordance with an array antenna beam pattern. Output from each of the respective array elements is passed to receiver 304 which collects and organizes the signal information for presentation to and processing by processor 306. Processor 306 receives and processes the array outputs in accordance with the extended-zero-transformation and signal restoration processes described above. Depending upon the nature of the array antenna, phase and amplitude adjustments may be performed by receiver 304 rather than by each of the respective antenna elements of array antenna 302.

Processor 306 may be implemented in single processor or a number of different processor that perform different functions. For example, processor 306 may be implemented by any combination of hardware and software that may be statically and/or dynamically configured to perform extended-zero-transformation and signal restoration as described above.

Figure 4:
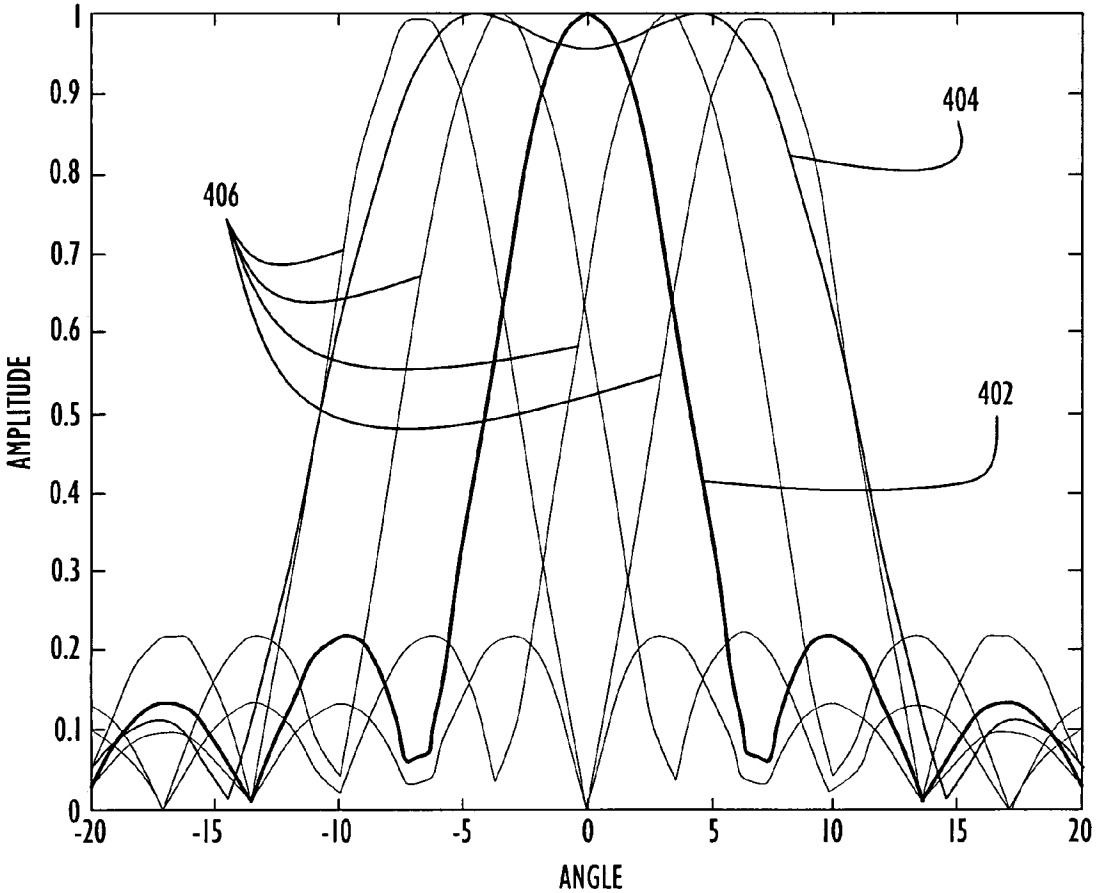
FIG. 4 is a graphical plot of an array antenna beam pattern, an interference signal and selected directional vectors for which extended-zero-transformation and signal restoration techniques are applied to a received signal to reject potential interference in accordance with an exemplary embodiment of the present invention.

Feasibility of EZT and signal restoration has been established in a number of computer simulation experiments. FIG. 4 presents a graphical plot of a representative array antenna beam pattern 402, a representative interference signal 404 and a set of four directional vectors 406, used to demonstrate the effectiveness of the extended-zero-transformation based approach. Beam pattern 402 is representative of a beam pattern that may be produced with a 17-element array antenna. Interference signal 404 is an interference continuum produced by twenty sine waves spaced 1° apart and centered on boresight. Given that the array includes seventeen elements, up to sixteen directional vector could be selected for application of the extended-zero-transformation based approach described above. To demonstrate the effectiveness of the EZT based approach, however, only four directional vectors were selected at −6.7 degrees, −3.4 degrees, +3.4 degrees and +6.7 degrees from boresight, as shown in FIG. 4 at 406.

Figure 5:
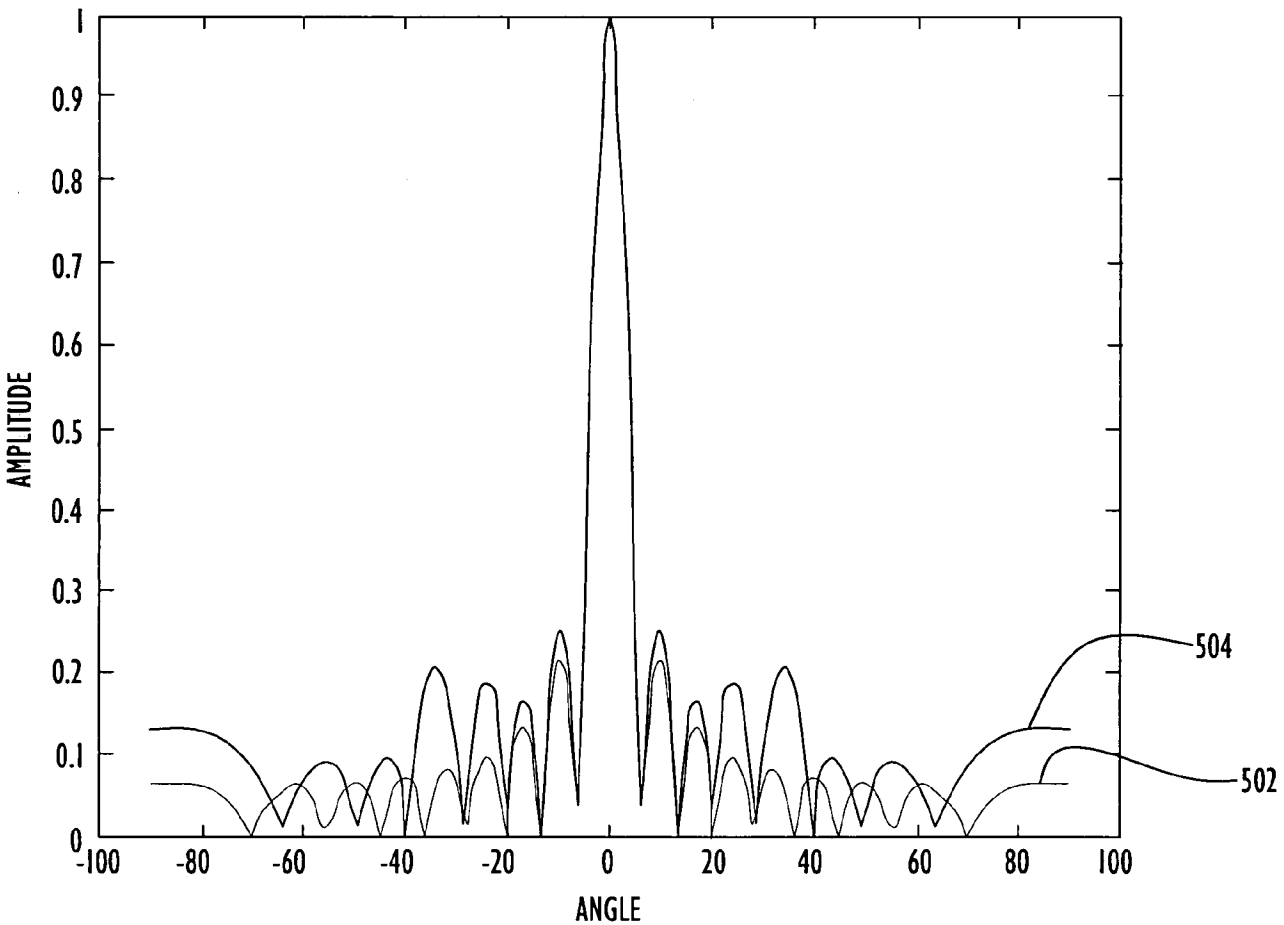
FIG. 5 is a graphical comparison of an array antenna beam pattern and a beam pattern generated by applying extended-zero-transformation and restoration techniques in accordance with an exemplary embodiment of the present invention.

FIG. 5 is a graphical plot of the results generated as a result of applying the EZT and signal restorations techniques, described above, to remove interference continuum 404 based upon the four selected directional vectors 406. Given that a received signal may be of any shape and form, FIG. 5, demonstrates the effectiveness of the EZT based approach by presenting the original beam pattern 502 superimposed over a validation beam pattern 504 generated based upon application of the EZT/restoration process. Extended-zero-transformation and signal restoration was applied to a signal/interference ensemble for the purpose of removing the interference and restoring the signal of interest. FIG. 5 demonstrates that upon execution of the extended-zero-transformation and signal restoration process, the main beam may be completely restored. The mismatch between the original beam pattern 502 and the restored beam pattern 504 in the side lobes is the result of applying a finite number (i.e. four) of EZT potential source of interference directional vectors to remove an interference continuum. The agreement can be made increasingly exact by including a larger number of directional vectors (e.g., up to sixteen in the present example) and applying restoration techniques corresponding to the additional directional vectors. The required number would depend on the application.

It will be appreciated that the embodiments described above and illustrated in the drawings represent only a few of the many ways of implementing and applying the extended-zero-transformation and signal restoration methods and apparatus described. The present invention is not limited to the specific applications disclosed herein, but may be used in any number of ways. For example, the limitations of conventional array signal reception techniques with respect to the inability to receive a single isolated signal from among a plurality of signals received from a plurality of closely spaced signal sources, limitations with respect to the ability to identify separate signal sources within a field of physical space containing a plurality of closely spaced signal sources, and limitations with respect to the ability to reject as interference signals in close proximity to a signal of interest, are easily overcome by the described methods and apparatus based upon improvements achieved in the effective resolving power of array antennas.

The extended-zero-transformation and signal restoration techniques described may be implemented in any number of modules. Each module can be implemented in any number of ways and is not limited in implementation to execute process flows precisely as described above. The extended-zero-transformation and signal restoration processes described above and illustrated in the flow charts and diagrams may be modified in any manner that accomplishes the functions described herein.

It is to be understood that various functions of the extended-zero-transformation and signal restoration method and apparatus may be distributed in any manner among any quantity (e.g., one or more) of hardware and/or software modules or units, computer or processing systems or circuitry.

Extended-zero-transformation and signal restoration techniques processing module(s) may be integrated within a stand-alone system or may execute separately and be coupled to any number of devices, workstation computers, server computers or data storage devices via any communications medium (e.g., network, modem, direct connection, etc.). The extended-zero-transformation and signal restoration process can be implemented by any quantity of devices and/or any quantity of personal or other type of computer or processing system (e.g., IBM-compatible, Apple, Macintosh, laptop, palm pilot, communication device, microprocessor, etc.). The computer system may include any commercially available operating system, any commercially available and/or custom software (e.g., communication software, etc.) and any types of input devices (e.g., radio receiver, etc.).

It is to be understood that the software of the extended-zero-transformation and signal restoration process may be implemented in any desired computer language, and could be developed by one of ordinary skill in the computer and/or programming arts based on the functional description contained herein and the flow charts illustrated in the drawings. Moreover, the extended-zero-transformation and signal restoration software may be available or distributed via any suitable medium (e.g., stored on devices such as CD-ROM and diskette, downloaded from the Internet or other network (e.g., via packets and/or carrier signals), downloaded from a bulletin board (e.g., via carrier signals), or other conventional distribution mechanisms).

Extended-zero-transformation and signal restoration output can be presented to the user and/or other processing modules in any manner using numeric and/or visual presentation and/or audible and/or electronic data formats. Further, any references herein of software performing various functions generally refer to computer systems or processors performing those functions under software control. The computer system may alternatively be implemented by hardware or other processing circuitry. The various functions of the extended-zero-transformation and signal restoration process may be distributed in any manner among any quantity (e.g., one or more) of hardware and/or software modules or units, computer or processing systems or circuitry, where the computer or processing systems may be disposed locally or remotely of each other and communicate via any suitable communications medium (e.g., LAN, WAN, Intranet, Internet, hardwire, modem connection, wireless, etc.). The software and/or processes described above and illustrated in the flow charts and diagrams may be modified in any manner that accomplishes the functions described herein.

The system of the present invention may be implemented using any of a variety of hardware and software configurations and is not limited to any particular configuration. For example, extended-zero-transformation and signal restoration processing may be performed with a signal received via any size of array antenna and is not limited to any particular number of receiving antenna elements and can be configured using any appropriate number and arrangement of antenna elements required to meet particular system requirements, such as beamwidth, scan angle, antenna gain, etc.

Virtually all applications that utilize directional antennas, such as array antennas, can benefit from utilization of the described extended-zero-transformation and signal restoration technique. These application include, but are not limited to, communication, navigation, and radar systems, such as future generations of GPS, GPS augmentation systems, wireless telephony, satellite communication systems, the Global Multi-Mission Service Platform (GMSP), systems employing code division multiple access (CDMA) multiplexing and other communication systems.

Having described preferred embodiments of new and improved methods and apparatus for extended-zero-transformation and signal restoration, it is believed that other modifications, variations and changes will be suggested to those skilled in the art in view of the teachings set forth herein. It is therefore to be understood that all such variations, modifications and changes are believed to fall within the scope of the present invention as defined by the appended claims. Although specific terms are employed herein, they are used in a generic and descriptive sense only and not for purposes of limitation.

What is claimed is:

1. A method of increasing an effective resolving power of an array antenna comprising an array of antenna elements capable of implementing an array antenna beam pattern, the method comprising:

(a) receiving a signal plus interference via the array antenna;

(b) selecting a plurality of evenly distributed angular directions within a main lobe of the array antenna beam pattern, the plurality of angular directions circumscribing an angle corresponding to a boresight of the array antenna beam pattern; and (c) removing from the received signal plus interference, interference received at the array antenna from a direction corresponding to at least one of said angular directions.

2. The method of claim 1, wherein (a) further comprises:

storing the signal plus interference as a vector comprising a plurality of vector components, wherein each vector component corresponds to a portion of the received signal plus interference received at a unique array antenna element.

3. The method of claim 2, wherein (b) further comprises:

constructing a plurality of directional vectors corresponding to the selected angular directions; and computing an extended-zero-transformation (EZT) matrix for which the plurality of directional vectors belong to a null space of the EZT matrix.

4. The method of claim 3, wherein (c) further comprises:

transforming the signal plus interference vector by the EZT matrix; and restoring the transformed signal plus interference vector.

5. The method of claim 3, wherein the array antenna comprises M antenna elements, k angular directions are selected from which a contribution to the received signal is to be removed, and the extended-zero-transformation matrix is an M×M matrix of rank M−k.

6. The method of claim 1, wherein (b) further includes:

selecting a plurality of angular directions corresponding to a side lobe of the array antenna beam pattern.

7. The method of claim 1, further comprising:

nulling interference from angular directions corresponding to a side lobe of the array antenna beam pattern using beamforming.

8. An apparatus for increasing an effective resolving power of an array antenna comprising an array of antenna elements capable of implementing an array antenna beam pattern, the apparatus comprising:

an antenna array module to receive a signal plus interference;

a processing module to select a plurality of evenly distributed angular directions within a main lobe of the array antenna beam pattern, the plurality of angular directions circumscribing an angle corresponding to a boresight of the array antenna beam pattern; and an interference module to remove from the received signal plus interference, interference received at the array antenna from a direction corresponding to at least one of said angular directions.

9. The apparatus of claim 8, wherein the antenna array module further comprises:

a storage module to store the signal plus interference as a vector comprising a plurality of vector components, wherein each vector component corresponds to a portion of the received signal plus interference received at a unique array antenna element.

10. The apparatus of claim 9, wherein the processing module further comprises:

a build module to construct a plurality of directional vectors corresponding to the selected angular directions; and a matrix module to compute an extended-zero-transformation (EZT) matrix for which the plurality of directional vectors belong to a null space of the EZT matrix.

11. The apparatus of claim 10, wherein the interference module further comprises:

a transformation module to transform the signal plus interference vector by the EZT matrix; and a restoration module to restore the transformed signal plus interference vector.

12. The apparatus of claim 10, wherein the array antenna includes M antenna elements and wherein the processing module further comprises:

a selection module to select k angular directions from which a contribution to the received signal is to be removed;

wherein the matrix module is configured to build an extended-zero-transformation matrix is an M×M matrix of rank M−k.

13. The apparatus of claim 8, wherein the processing module further comprises:

a distribution module to select a plurality of angular directions corresponding to a side lobe of the array antenna beam pattern.

14. The apparatus of claim 8, further comprising:

a beamforming module to null interference from angular directions corresponding to a side lobe of the array antenna beam pattern using beamforming.

15. A program product apparatus having a computer readable medium with computer program logic recorded thereon for increasing an effective resolving power of an array antenna comprising an array of antenna elements capable of implementing an array antenna beam pattern, said program product apparatus comprising:

an antenna array module to receive a signal plus interference;

a processing module to select a plurality of evenly distributed angular directions within a main lobe of the array antenna beam pattern, the plurality of angular directions circumscribing an angle corresponding to a boresight of the array antenna beam pattern; and an interference module to remove from the received signal plus interference, interference received at the array antenna from a direction corresponding to at least one of said angular directions.

16. The program product of claim 15, wherein the antenna array module further comprises:

a storage module to store the signal plus interference as a vector comprising a plurality of vector components, wherein each vector component corresponds to a portion of the received signal plus interference received at a unique array antenna element.

17. The program product of claim 16, wherein the processing module further comprises:

a build module to construct a plurality of directional vectors corresponding to the selected angular directions; and a matrix module to compute an extended-zero-transformation (EZT) matrix for which the plurality of directional vectors belong to a null space of the EZT matrix.

18. The program product of claim 17, wherein the interference module further comprises:

a transformation module to transform the signal plus interference vector by the EZT matrix; and a restoration module to restore the transformed signal plus interference vector.

19. The program product of claim 17, wherein the array antenna includes M antenna elements and wherein the processing module further comprises:

a selection module to select k angular directions from which a contribution to the received signal is to be removed;

wherein the matrix module is configured to build an extended-zero-transformation matrix is an M×M matrix of rank M−k.

20. The program product of claim 15, wherein the processing module further comprises:

a distribution module to select a plurality of angular directions corresponding to a side lobe of the array antenna beam pattern.

21. The program product of claim 15, further comprising:

a beamforming module to null interference from angular directions corresponding to a side lobe of the array antenna beam pattern using beamforming.

* * * * *